US005451173A

United States Patent [19]

Mai

[11] Patent Number: 5,451,173

[45] Date of Patent: Sep. 19, 1995

[54] SAFETY PLUG

[76] Inventor: Chao-Lin Mai, No. 1, Alley 2, Lane 94, Po Ai Street, Hsinchu City, Taiwan

[21] Appl. No.: 278,339

[22] Filed: Jul. 21, 1994

[51] Int. Cl.[6] ..... H01R 13/68

[52] U.S. Cl. ..... 439/622

[58] Field of Search ..... 439/621, 622; 337/197, 337/198

[56] References Cited

U.S. PATENT DOCUMENTS

| | | | |
|---|---|---|---|
| 4,275,374 | 6/1981 | Chaucer | 439/622 |
| 4,388,604 | 6/1983 | Ahroni | 439/197 |
| 4,575,704 | 3/1986 | Pezoid | 339/197 |
| 4,679,877 | 7/1987 | Ahroni | 439/622 |
| 4,684,914 | 8/1987 | Wu | 439/622 |
| 4,904,976 | 2/1990 | Liaq | 439/622 |
| 5,320,563 | 6/1994 | Liao | 439/622 |

*Primary Examiner*—Gary F. Paumen

*Attorney, Agent, or Firm*—Varndell Legal Group

[57] ABSTRACT

A safety plug including an insulative base frame mounted within an insulative housing to hold a positive contact metal blade and a negative contact metal blade, and a tubular fuse connected between the hot wire of an electric cord and the positive contact metal blade to automatically cut off the circuit upon an electric overload.

1 Claim, 4 Drawing Sheets

SAFETY PLUG

BACKGROUND OF THE INVENTION

The present invention relates to a electric plugs and, more particularly, to a safety plug which automatically cuts off the power supply upon an overload.

Various electric plugs have been disclosed for use with a variety of electric appliances. Conventional electric plugs are generally comprised of an insulative housing and two contact metal blades extended from the housing in the same direction. Some electric plugs have a grounding prong for connection to an earth terminal. Conventional electric plugs commonly have no overload protection, therefore they may be burnt out easily upon an electric overload.

The present invention has been accomplished to provide a safety plug which eliminates the aforesaid problem. This object is achieved by connecting a tubular fuse between the hot wire of the electric cord and the positive contact metal blade. The tubular fuse automatically cuts off the circuit upon an electric overload.

DETAILED DESCRIPTION OF THE PREFERRED EMBODIMENT

Figure 1:
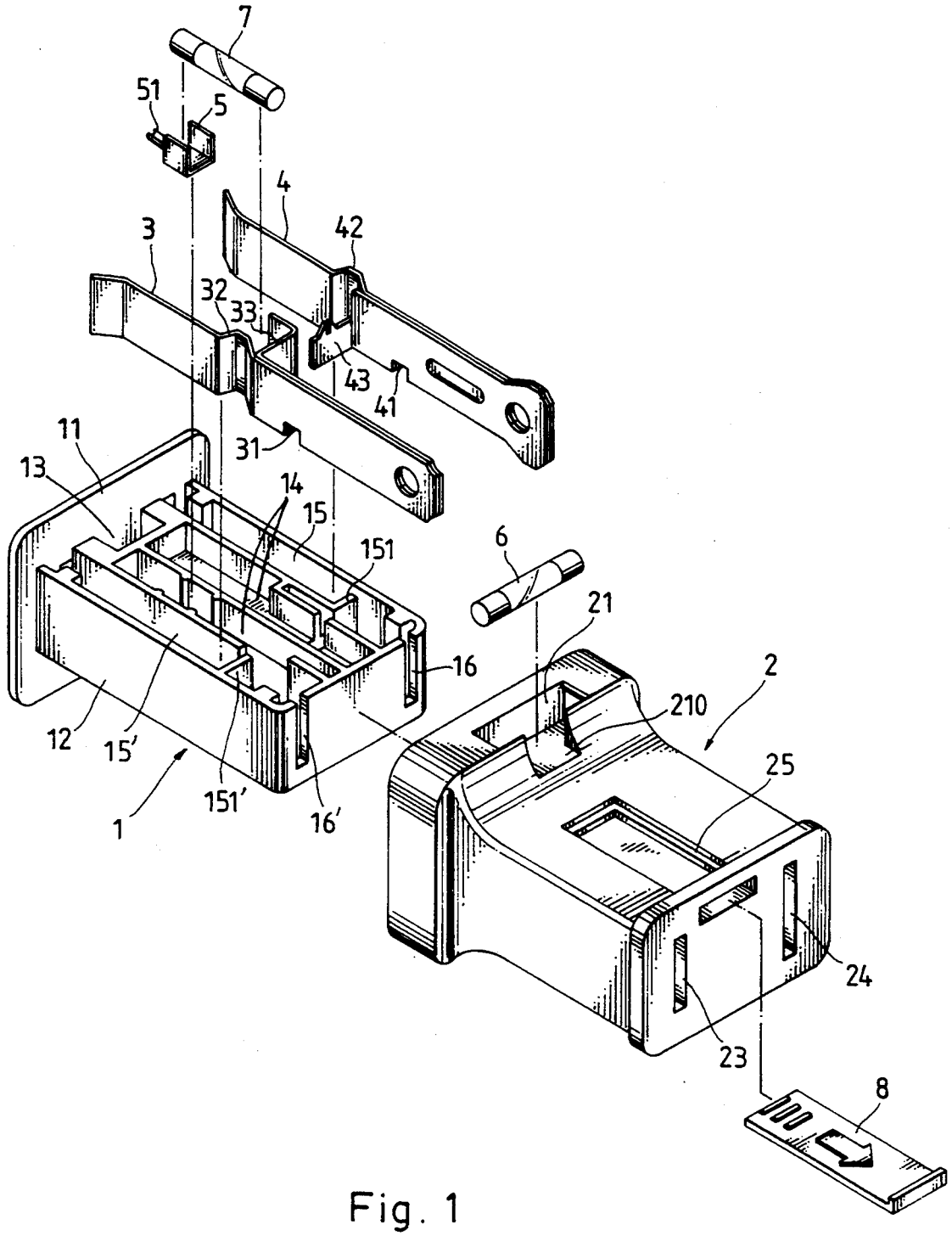
FIG. 1 is an exploded view of a safety plug according to the present invention.
Figure 2:
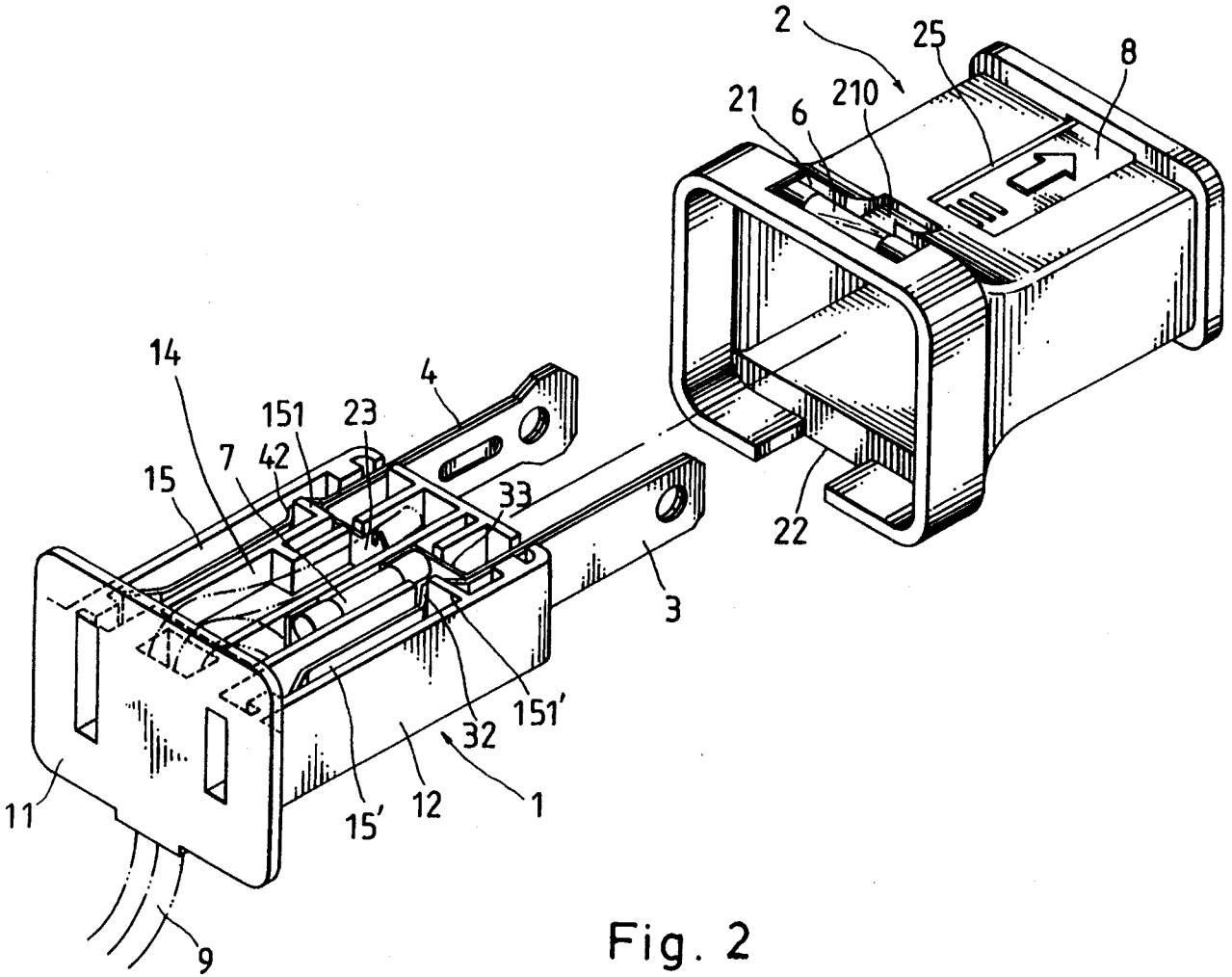
FIG. 2 is an assembly view of the safety plug shown in FIG. 1.
Figure 3:
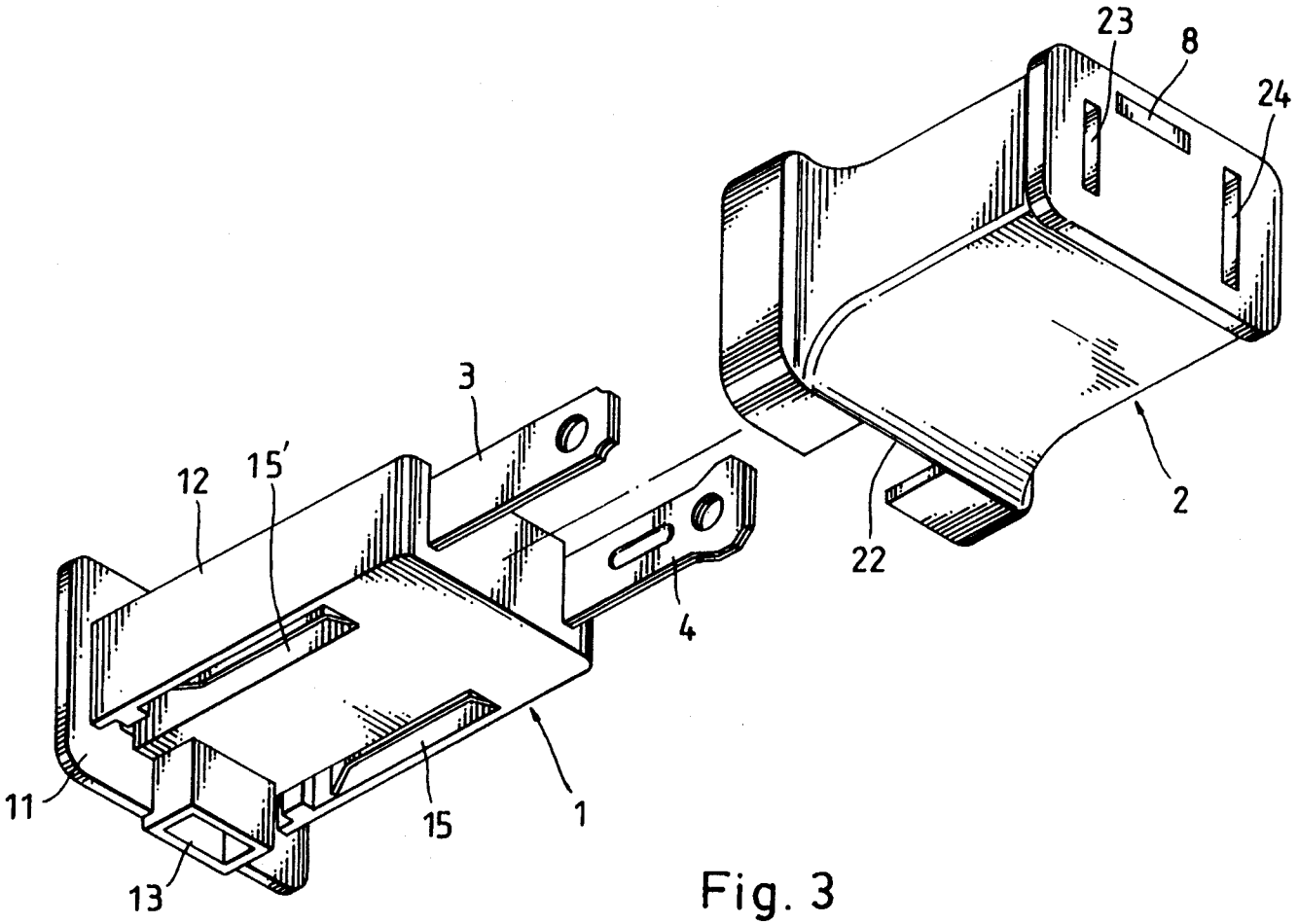
FIG. 3 is similar to FIG. 2 but taken from another direction.
Figure 4:
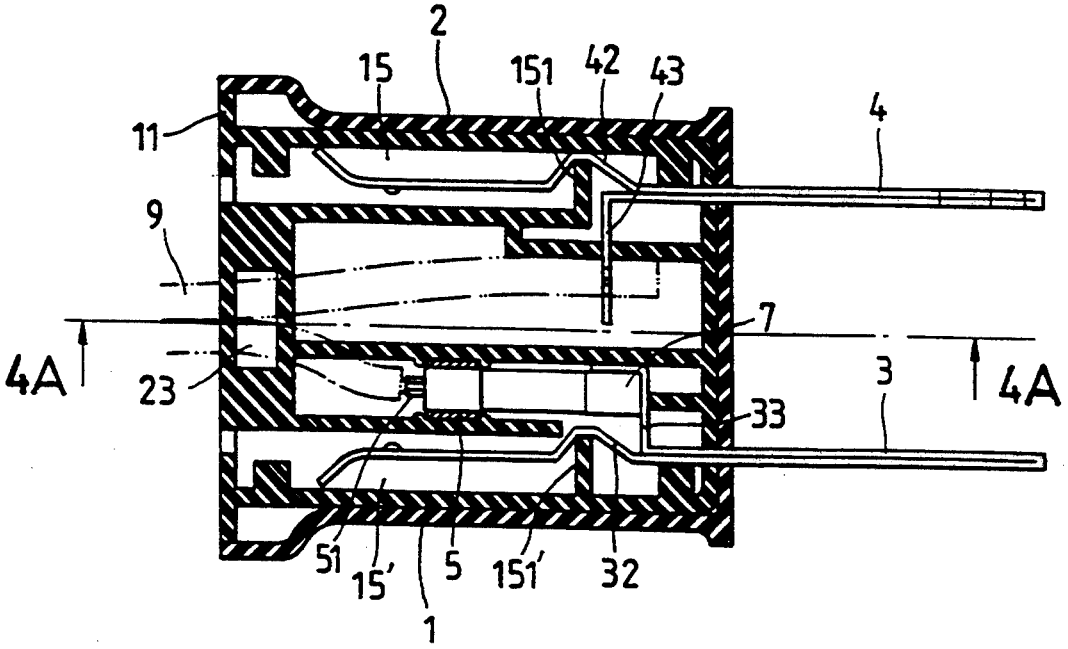
FIG. 4 is a side elevation in section of the safety plug shown in FIG. 1.
Figure 4A:
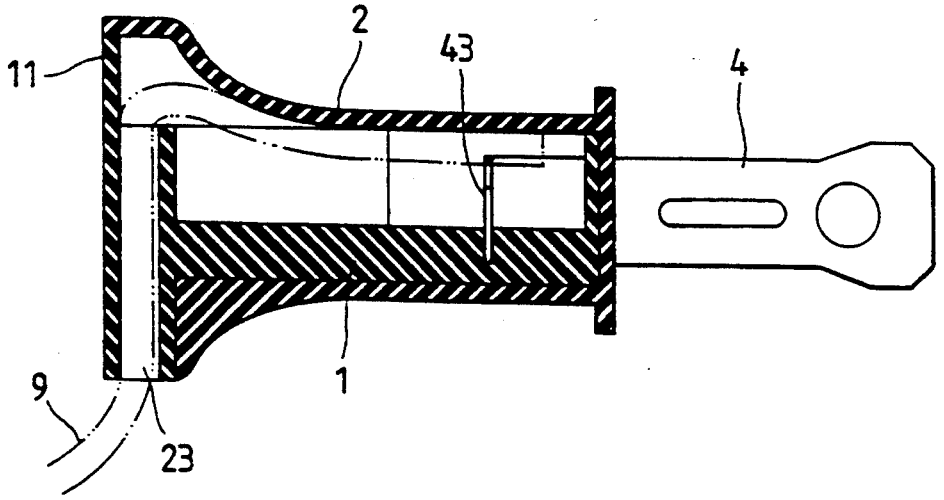
FIG. 4A is a sectional view taken along line 4A—4A of FIG. 4.

Referring to FIGS. 1 through 5, a safety plug in accordance with the present invention is generally comprised of an insulative base frame 1, an insulative housing 2, a positive contact metal blade 3, a negative contact metal blade 4, and a connector 5.

The insulative base frame 1 comprises a flat wall 11, a substantially rectangular block 12 perpendicularly extended from the flat wall 11 and fitted into the insulative housing 2. The rectangular block 12 comprises a wire slot 13 adjacent to the flat wall 11 for inserting the electric cord 9, two holes 14 for holding the ends of the neutral and hot wires of the electric cord 9 respectively, two longitudinal slots 15 and 15′ for holding the positive and negative contact metal blades 3 and 4 respectively. The insulative housing 2 comprises a transverse open chamber 21 at the top on the outside, which receives a spare tubular fuse 6, a finger slope 210 extended from the transverse open chamber 21 for permitting a finger to be inserted into the transverse open chamber 21 to pick up the spare fuse tube 6, a front notch 22 at the bottom aligned with the wire slot 13 for receiving the electric cord 9, two blade slots 23 and 24 at the front side for receiving the positive and negative contact metal blades 3 and 4, an access hole 25 longitudinally disposed at the top and covered with a sliding cover 8. The inside wall of the transverse open chamber 21 may be embossed so that the spare fuse tube 6 can be firmly retained in place when it is inserted into the transverse open chamber 21. The positive contact metal blade 3 is received in one longitudinal slot 15′ and extends out of one blade slot 23 of the insulative housing 2; and it has a retaining notch 31 engaged with a respective slot 16′ on the insulative base frame 1, a bent portion 32 abutting at a respective projecting portion 151′ inside the longitudinal slot 15′, and a curved side flange 33 matching the shape of the connector 5 a tubular fuse 7. The negative contact metal plate 4 is received in the other longitudinal slot 15 and extends out of the other blade slot 24 of the insulative housing 2; and it has a retaining notch 41 engaged with a respective slot 16 on the insulative base frame 1, a bent portion 42 abutting a respective projecting portion 151 inside the longitudinal slot 15, and a side flange 43 piercing the insulator of the neutral wire of the electric wire 9 to make an electric contact. The contact end of the negative contact metal blade 4 is relatively broader than that of the positive contact metal blade 3 for quick identification. The connector 5 is disposed inside the insulative base frame 1 to hold one end of the tubular fuse 7, having a tail 51 connected to the hot wire of the electric wire 9. Therefore, when installed, the fuse tube 7 is connected between the positive contact metal blade 3 and hot wire of the electric cord 9. In case of an electric overload, the tubular fuse 7 automatically cuts off the circuit to prevent short circuiting.

I claim:

1. A safety plug comprising:

an insulative housing having a top with a transversely arranged open chamber for holding a spare tubular fuse, a finger slope extended from said open chamber having a shape for permitting a finger to be inserted into said open chamber, a bottom with a front notch for receiving an electric cord, a front with a first blade slot and a second blade slot, an access hole longitudinally disposed at said top, and a sliding cover covering said access hole;

an insulative base frame having a flat wall abutting said insulative housing, a substantially rectangular block perpendicularly extending from said flat wall and fitted into said insulative housing, said rectangular block comprising a cord slot, through which said electric cord passes, a first longitudinal blade chamber and a second longitudinal blade chamber, a first projecting portion inside said first longitudinal blade chamber, and a second projecting portion inside said second longitudinal blade chamber;

a positive contact metal blade received in said first longitudinal blade chamber and extending out of said first blade slot, having a bent portion in a middle thereof abutting said first projecting portion and a curved side flange adjacent to said bent portion;

a connector received inside said insulative base frame and connected to a hot wire of said electric cord;

a tubular fuse connected between said connector and said side flange of said positive contact metal blade; and a negative contact metal plate received in said second longitudinal blade chamber and extending out of said second blade slot, having a bent portion abutting said second projecting portion and a side flange connected to a neutral wire of said electric wire.

* * * * *